United States Patent [19]

Leng et al.

[11] Patent Number: 4,880,569

[45] Date of Patent: Nov. 14, 1989

[54] CONCENTRATED LIQUID DETERGENT COMPOSITION CONTAINING ANIONIC SURFACTANTS HAVING NON-TERMINAL SULFONATE GROUPS

[75] Inventors: Francis J. Leng; Christine A. Leng, both of Merseyside, England

[73] Assignee: Lever Brothers Company, New York, N.Y.

[21] Appl. No.: 142,291

[22] Filed: Jan. 5, 1988

Related U.S. Application Data

[63] Continuation of Ser. No. 875,430, Jun. 17, 1986, abandoned.

[30] Foreign Application Priority Data

Jun. 21, 1985 [GB] United Kingdom ..... 8515721
Oct. 4, 1985 [GB] United Kingdom ..... 8524602

[51] Int. Cl.[4] ..... C11D 1/14; C11D 1/72

[52] U.S. Cl. ..... 252/550; 252/551; 252/554; 252/555; 252/557; 252/559; 252/174.21; 252/DIG. 2; 252/DIG. 14; 252/174.17

[58] Field of Search ..... 252/550, 551, 554, 555, 252/557, 559, 108, 132, DIG. 2, DIG. 14, 174.16

[56] References Cited

U.S. PATENT DOCUMENTS

| | | | |
|---|---|---|---|
| 3,303,138 | 2/1967 | DeWitt et al. | 252/559 |
| 3,919,125 | 11/1975 | Ashina et al. | 252/551 |
| 4,224,195 | 9/1980 | Kawasaki et al. | 252/546 |
| 4,239,660 | 12/1980 | Kingry | 252/528 |
| 4,412,945 | 11/1983 | Takahashi et al. | 252/551 |
| 4,492,646 | 1/1985 | Welch | 252/528 |
| 4,495,092 | 1/1985 | Schmid et al. | 252/559 |
| 4,596,672 | 6/1986 | MacDuff et al. | 252/544 |
| 4,615,819 | 10/1986 | Leng et al. | 252/110 |

FOREIGN PATENT DOCUMENTS

| | | |
|---|---|---|
| 102124 | 3/1984 | European Pat. Off. . |
| 107946 | 5/1984 | European Pat. Off. . |
| 125854 | 11/1984 | European Pat. Off. . |
| 64209 | 6/1978 | Japan . |
| 53-064209 | 6/1978 | Japan . |
| 1114359 | 5/1968 | United Kingdom . |
| 1429637 | 3/1976 | United Kingdom . |
| 1551074 | 8/1979 | United Kingdom . |
| 1567421 | 5/1980 | United Kingdom . |
| 1573908 | 8/1980 | United Kingdom . |
| 2104913 | 3/1983 | United Kingdom . |
| 2105325 | 3/1983 | United Kingdom . |
| 2108520 | 5/1983 | United Kingdom . |
| 2116994 | 10/1983 | United Kingdom . |
| 2130238 | 4/1984 | United Kingdom . |
| 2133793 | 8/1984 | United Kingdom . |
| 2158455 | 11/1985 | United Kingdom . |
| 2158456 | 11/1985 | United Kingdom . |

*Primary Examiner*—Prince E. Willis
*Attorney, Agent, or Firm*—Milton L. Honig

[57] ABSTRACT

A concentrated liquid detergent composition which can be liquid at or below ambient temperature comprises (i) at least 40 wt % and less than 92 wt % of a mixture of surfactants, at least 50 wt % of the surfactants present comprising:

(a) a polyalkoxy nonionic surfactant conforming to the general formula

RVEW wherein

R is an aliphatic and/or araliphatic hydrocarbon moiety,

V is a linking group,

E is a polyethoxy and/or polypropoxy and

W is a nonionic end group, the nonionic surfactant for the portion RE having a hydrophile-lipophile balance of at least 14.5 where E is polyethoxy and an equivalent hydrophile-lipophile balance where E is propoxy, and (b) an ionic surfactant having a non-terminal ionic head group with two or more hydrocarbon chains extending from the head group, each chain being no more than 10 carbon atoms in length and the chains having a total length of at least 8 carbon atoms;

wherein the ratio of (a) to (b) lies within the range of from 1:9 to 9:1, and (ii) at most 60 wt % and more than 8 wt % water.

15 Claims, 1 Drawing Sheet

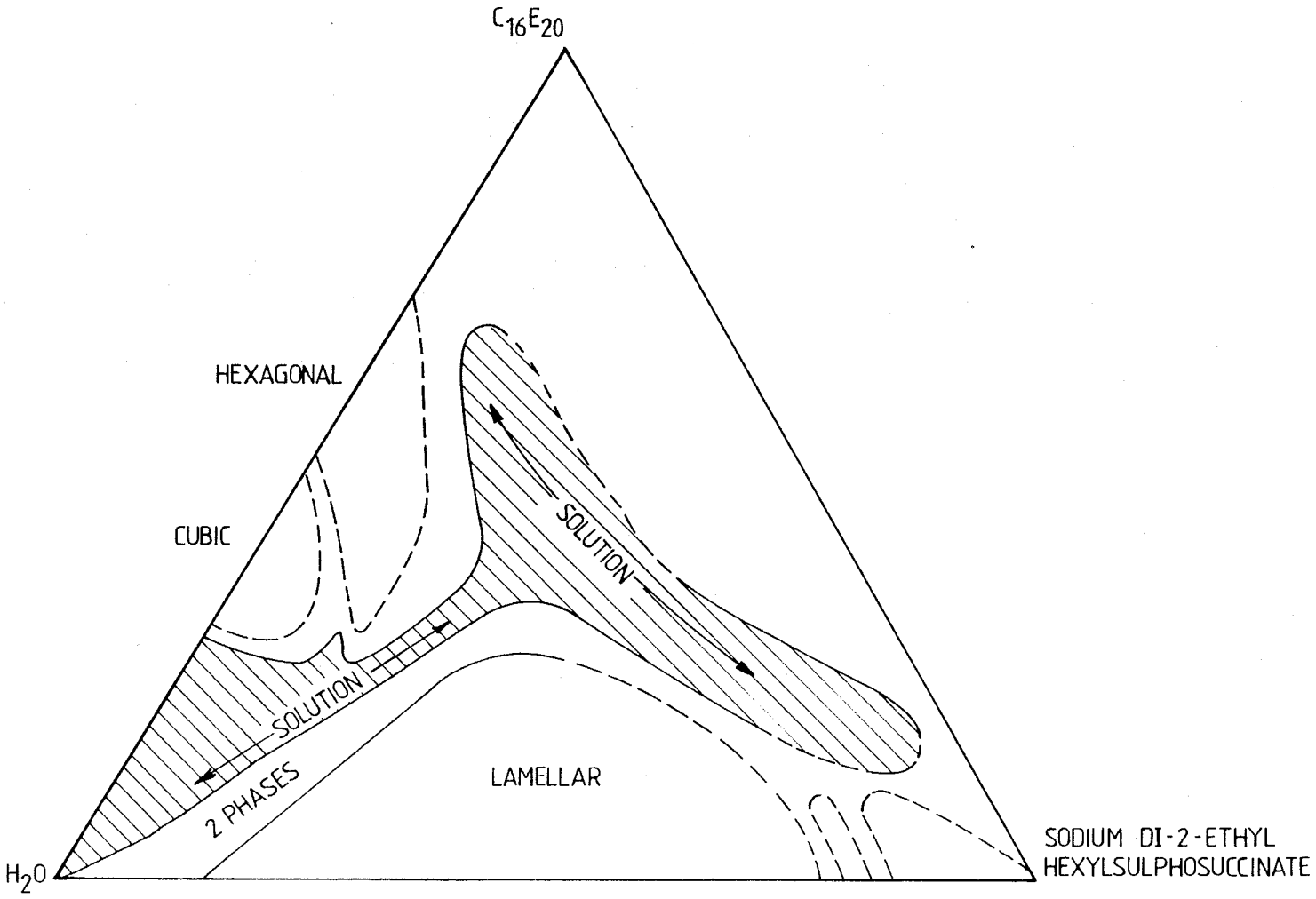
SODIUM DI-2-ETHYL
HEXYLSULPHOSUCCINATE
$C_{16}E_{20}$
$H_2O$
SOLUTION
LAMELLAR
HEXAGONAL
CUBIC
SOLUTION
2 PHASES

CONCENTRATED LIQUID DETERGENT COMPOSITION CONTAINING ANIONIC SURFACTANTS HAVING NON-TERMINAL SULFONATE GROUPS

This is a continuation of Ser. No. 875,430, filed June 17, 1986, now abandoned.

FIELD OF THE INVENTION

The present invention relates to a liquid detergent composition and to a process for making a liquid detergent composition.

BACKGROUND OF THE INVENTION

Liquid detergent compositions can either be used neat or, more usually, after dilution with water. Examples of the latter are in fabric and dishwashing. In order to reduce transport and storage costs and problems, not only of the producer but also of the consumer, it would be advantageous to produce a liquid detergent composition in a form more concentrated than that normally commercially available at present.

In use the consumer would thus ideally use a smaller amount of a concentrated detergent composition than that he is accustomed to using in the case of a conventional liquid detergent composition. On e.g. dilution with water however a similar result in terms of detergency should be obtained.

In order to produce a concentrated liquid detergent composition it is not however merely a simple matter of taking a commercially available liquid detergent composition and reducing its water content. Commercially available liquid detergent compositions are specially formulated to retain their liquid and homogenous state over a range of temperatures and their ready dispersibility in water on dilution. Such properties can by no means be assured if the water concentration of the compositions is decreased.

SUMMARY OF THE INVENTION

According to the present invention there is provided a liquid detergent composition comprising (i) at least 40 wt% and less than 92 wt% of a mixture of surfactants, at least 50 wt% of the surfactants present comprising:

(a) a polyalkoxy nonionic surfactant conforming to the general formula

RVEW wherein

R is an aliphatic and/or araliphatic hydrocarbon moiety,

V is a linking group,

E is a polyethoxy and/or polypropoxy and

W is a nonionic end group, the nonionic surfactant for the portion RE having a hydrophile-lipophile balance of at least 14.5 where E is polyethoxy and an equivalent hydrophile-lipophile balance where E is propoxy, and (b) an ionic surfactant having a non-terminal ionic head group with two or more hydrocarbon chains extending from the head group, each chain being no more than 10 carbon atoms in length and the chains having a total length of at least 8 carbon atoms; wherein the ratio of (a) to (b) lies within the range of from 1:9 to 9:1, and (ii) at most 60 wt% and more than 8 wt% water.

BRIEF DESCRIPTION OF DRAWING

The sole FIGURE is a three-component phase diagram corresponding to the surfactant system outlined in Example 1.

DETAILED DESCRIPTION

We have found that by means of the present invention concentrated liquid detergent compositions can be formulated which maintain their liquid and homogeneous isotropic nature down to conventional storage temperatures and which can readily be dispersed on dilution with water. In particular we have found that by means of the present invention we can provide, with suitable formulations of surfactants, a concentrated liquid detergent composition whose Krafft temperature is at or below an ambient temperature such as 25° C. The advantageous results which can be achieved by means of the present invention are believed to be due to the combination of the defined nonionic surfactant and the specified molecular structure of the ionic surfactant. By chain length of the hydrocarbon chains extending from the head group we mean the longest uni-directional hydrocarbon chain length present in the hydrocarbon moiety concerned. Thus for example if an alkyl hydrocarbon chain has interposed within its length a para phenyl group (i.e. 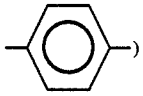 )

the presence of the phenyl group contributes only 4 carbon atoms as counted along the direction of the chain, or for example if an alkyl hydrocarbon chain contains branching the chain length is determined by the longest continuous linear chain length present, for instance 2-ethyl hexyl (i.e. $CH_3—CH_2—CH_2—CH_2—CH(C_2H_5)—CH_2—$) counts as a hydrocarbon being 6 carbon atoms in length. If an ester linkage or the like is present in the head group of the ionic surfactant e.g. where the ionic surfactant is a sulphosuccinate, the hydrocarbon claims, in keeping with the above definition, are the alkyl moieties excluding the ester linkage and the e.g. sulphosuccinate moiety which provide the head group.

Preferably the chain length of each hydrocarbon chain is less than or equal to 8 C, more preferably less than or equal to 7 C. One hydrocarbon chain can contain only 2 C, subject to the requirement that the chains in total have a length of at least 8 C. Preferably the shortest chain is 4 C.

Suitably only two hydrocarbon chains extend from the head group. The chains can be alkyl or arylalkyl. Any of the chains may be substituted and in the case of alkyl chains branched and/or unsaturated. Branching is particularly preferred.

The nonionic surfactant is preferably a polyethoxy surfactant with a hydrophile-lipophile balance (HLB) of at least 15. Suitably the HLB of the polyethoxy nonionic is at most 19, more suitably at most 17.

For polyethoxy ethers the following formula provides a ready way of assessing its HLB:

$$HLB = \frac{\text{molecular wt of poly ethoxy moiety}}{\text{total molecular wt of polyether}} \times 20$$

Thus for example for a polyethoxy ether of the general formula:

$CH_3(CH_2)_{n-1}(CH_2CH_2O)_mOH$ (abbreviated to $C_nE_m$) in the case where n=m, HLB=15–17.

Preferably for the polyethers having an alkyl moiety containing C atoms, n is at least 2 and at most 24. More preferably n is at most 16, even more preferably n is at most 12.

R in the polyalkoxy nonionic surfactant can be substituted, branched and/or unsaturated. V in the polyalkoxy nonionic surfactant can be for example —$CH_2$—, —NH—, —CONH—, —CON—, —COO—, —S—, —$C_6H_4$—, ethoxy or propoxy. The ether group in the polyalkoxy surfactant is suitably non-terminal. W in the polyalkoxy surfactant can be —OH or $CH_3$.

Combinations of the defined nonionic surfactant and the defined ionic surfactant with more than 8 wt% water can be provided to meet a variety of circumstances. For example in warmer climates a composition with a higher clear point (i.e. the temperature at which with increasing temperature the composition passes from a multi-phase system to a clear isotropic solution) may be more acceptable than in a climate where the composition may be stored for periods of time at a cooler temperature. Similarly ready dispersibility of the concentrated composition in water can be achieved by selecting the appropriate combination of surfactants at suitable ratios. Preferably the ratio of nonionic to anionic surfactant lies within the range 2:1 to 1:2, being optimally 1:1. For any particular system the ratio must however be selected appropriately.

The preferred proportion of the mixture of surfactants in the present composition will depend upon the embodiment of the invention of interest. Generally however the present composition comprises at least 60 wt % of the mixture of surfactants (i), more preferably at least 80 wt % of the said mixture. In some instances for example where the ionic surfactant conforms to the general formula $R_3$-Z-$R_4$ given below e.g. is sulphosuccinate the preferred range of the mixture of surfactants present in the composition may be from 50 to 80 wt %, more preferably from 60 to 70 wt %.

If desired, additional nonionics and/or ionic surfactants and/or zwitterionic surfactants other than those presently defined may be included. Any additional ionic surfactant should be of the same charge as the defined ionic surfactant present. Examples of additional surfactants that may be present include coconut diethanolamide, coconut ethanolamide, amine oxides, primary ether sulphates, polyethers, soaps, primary alkyl benzene sulphonates, primary olefin sulphonates and primary alkyl sulphates. Any additional surfactant included however in the mixture will be present in a total amount less than (a)+(b).

The present compositions can thus provide concentrated liquid detergent compositions that are not only clear, isotropic liquids of low viscosity at low temperatures allowing their ready storage, transport and processing e.g. pumpability at temperatures below e.g. 25° C., but also readily dilutable with water in use without formation of intermediate liquid crystalline phases. An additional advantage of the present compositions is that they can be formulated, if desired, without the addition of conventional hydrotropes such as lower alcohols e.g. ethanol. The absence of such lower alcohols provides advantages in terms of decreased odour, cost and, in manufacture, flammability hazards.

The ionic surfactant can be any surfactant complying with present definition (b).

A first class of surfactants which comply with definition (b) are provided by compounds which conform to the general formula:

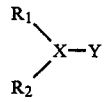

wherein Y is the ionic head group $R_1$ and $R_2$ are aliphatic or araliphatic hydrocarbon moieties, and X is a hydrocarbon moiety, each hydrocarbon chain being defined as the group $R_1$-X and $R_2$-X respectively, the component C atoms of X contributing only once to the requirement that the chains together have a total length of at least 8 carbon atoms.

X can for example be selected from the group comprising:

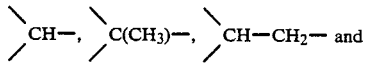

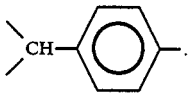

Y can for example be selected from the group comprising sulphate, sulphonate, phosphate, ether sulphate and mixtures thereof. Examples of particular surfactants falling within the present class include alkylbenzene sulphonates, secondary alkane sulphonates, secondary alkyl sulphates, secondary alkyl ether sulphates, secondary olefin sulphonates and mixtures thereof.

A second class of surfactants which comply with definition (b) are provided by compounds which conform to the general formula:

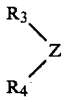

wherein Z is the ionic head group, and $R_3$ and $R_4$ are aliphatic or araliphatic hydrocarbon moieties comprising the said hydrocarbon chains.

Z can for example be selected from the group comprising sulphosuccinates, sulphosuccinamates, sulphono carboxylic esters, amino sulphonic esters and mixtures thereof.

Alternatively Z can for example be selected from the group comprising amino, alkyl substituted ammonium, ethanol substituted ammonium, phosphonium, alkyl substituted phosphonium, ethanol substituted phosphonium, nitrogen ring compounds and mixtures thereof. Examples of nitrogen ring compounds include pyridinium and imidazoline.

As can be seen the ionic head group of (b) can be anionic or cationic. Where it is anionic, the counterion can for instance be selected from the group comprising alkali metals, alkaline earth metals, ammonium, alkyl substituted ammonium, ethanol substituted ammonium and mixtures thereof, ammonium and alkyl substituted ammonium being preferred for e.g. reasons of lowering the Krafft temperature and low temperature storage stability. Where it is cationic the counterion can for instance be selected from the group comprising halide ions ($F^-$, $Cl^-$, $Br^-$, $I^-$) and organic acid ions (e.g. $-COO^-$).

In addition to the water and surfactants mentioned above the present concentrated liquid detergent composition can contain one or more of the following conventional ingredients in the usual amounts: colourants, perfumes, bleach, enzymes, fluorescer, soluble builders and thickening agents.

It is to be understood that the present invention extends to a process for making the present composition by admixing the defined ingredients in the presently specified proportions.

Embodiments of the present invention will now be described by way of example only with reference to the following Examples, in which, unless otherwise stated, all percentages are by weight of the total final liquid detergent composition, and to the accompanying FIGURE which shows in diagrammatic form the three component phase diagram for the system employed in Example 1.

EXAMPLE 1

The tripartite system comprising water, sodium di-2-ethylhexylsulphosuccinate and the polyether $C_{16}E_{20}$ (commercially available as Brij 58) was studied at 25° C. over a range of varying compositions to establish a portion of its phase diagram. The phase diagram constructed is shown in the accompanying FIGURE. Of particular interest is the hatched portion which has been found to be single phase liquid area. Regions adjacent this area comprise two phase systems consisting of a mixture of liquid and some form of gel, the form depending mainly on the ratio of nonionic to anionic surfactant present. The shape of the hatched portion is of importance as it extends for a major part along an axis extending from approximately 100% $H_2O$ point. The present system thus allows formulations to be made up which if lying on or near this axis will, in use on dilution with water, not separate into a two-phase system and will thus be readily dispersible in water.

A range of compositions of the present system were made up, varying in water content and in the ratio of nonionic to anionic surfactant present. Each composition was then diluted with a large excess of water and the form of the composition noted. The results are given in Table I below.

TABLE I

| Sodium di-2-ethylhexyl succinate (wt %) | $C_{16}E_{20}$ (wt %) | Total active (wt %) | Water (wt %) | Form on dilution |
|---|---|---|---|---|
| 2 | 0 | 2 | 98 | |
| 80 | 12 | 92 | 8 | |
| 81 | 15 | 96 | 4 | |
| 80 | 16 | 96 | 4 | |
| 76 | 20 | 96 | 4 | |
| 70 | 23 | 93 | 7 | |
| 60 | 28 | 88 | 12 | |
| 50 | 33 | 83 | 17 | |
| 40 | 39 | 79 | 21 | |
| 36 | 43 | 79 | 21) | isotropic on |

TABLE I-continued

| Sodium di-2-ethylhexyl succinate (wt %) | $C_{16}E_{20}$ (wt %) | Total active (wt %) | Water (wt %) | Form on dilution |
|---|---|---|---|---|
| 28 | 50 | 78 | 22) | dilution |
| 10 | 7 | 17 | 83 | |
| 7 | 7 | 14 | 86 | |
| 0 | 28 | 28 | 72 | |

EXAMPLE 2

The tripartite system water, sodium di-2-ethylhexylsulphosuccinate and the polyether $C_{6-10}E_{14}$ (available commercially as Alfol 610–14) was studied at a range of temperatures from −16° to +40° C. and varying water content. In each case the weight ratio of sulphosuccinate to polyether was maintained at 1:1. The results in terms of total active (anionic plus nonionic) present versus clear point are given in Table II below.

TABLE II

| | | | | |
|---|---|---|---|---|
| Total active | (wt %) | 93 | 87 | 79 |
| Clear point | (°C.) | <0 | <0 | 18 |

EXAMPLE 3

The tripartite system water, sodium dialkylsulphosuccinate and polyether of $C_{16}E_{20}$ (available commercially as Brij 58) was studied over the temperature range 15° to 40° C. with varying water content and a constant 1:1 weight ratio of sulphosuccinate to polyether. The alkyl chains of the sulphosuccinate were a 50:50 molar mixture of octyl and hexyl moieties randomly distributed. The results in terms of total active present (anionic plus nonionic) versus clear point are given in Table III below. At the level of 78 wt% polyether plus sulphosuccinate 3 wt% additional nonionic of 2 phenyl ethanol acting as a perfume was present.

TABLE III

| | | | | | | | | |
|---|---|---|---|---|---|---|---|---|
| Total active (wt %) | 88 | 81 | 78 | 70 | 64 | 57 | 50 | 43 |
| Clear point (°C.) | 40 | 33 | 29 | 23 | 23 | 23 | 22 | 17 |

EXAMPLE 4

The system water, sodium dialkylsulphosuccinate and the polyether $C_{6-10}E_{14}$ (available commercially as Alfol 610–14) was studied over the temperature range 15° to 40° C. at a water content of 11% and 1:1 weight ratio of sulphosuccinate to polyether. The sulphosuccinate employed was as in Example 3. At a total active level of 89% the system had a clear point of 30° C.

EXAMPLE 5

The tripartite system water, a mixed dialkylsulphosuccinate and the polyether $C_{16}E_{20}$ (available commercially as Brij 58) was studied over a range of temperature at varying water concentrations with a constant 1:1 weight ratio of the mixed sulphosuccinate to the polyether. The sulphosuccinate employed has as countercations a mixture of ammonium and sodium ions in a ratio of ammonium ions to sodium ions of 3:7 and the mixture of $C_6$ and $C_8$ dialkyl chains as set out in Example 3.

The results in terms of total active present versus clear point are given in Table IV below.

TABLE IV

| | | | | | |
|---|---|---|---|---|---|
| Total active | (wt %) | 84 | 75 | 69 | 62 |
| Clear point | (°C.) | 30 | 27 | 23 | 22 |

EXAMPLE 6

The tripartite system water, sodium dodecyl secondary sulphate with the sulphate attached at the $C_6$ position in the dodecyl chain, and the polyether $C_{6-10}E_{14}$ (available commercially as Alfol 610–14) was studied over a range of temperatures at varying water concentrations whilst maintaining the weight ratio of anionic to nonionic constant at 1:1.

The results in terms of total active present versus clear point are given in Table V below.

TABLE V

| | | | | | |
|---|---|---|---|---|---|
| Total Active | (wt %) | 90 | 83 | 70 | 59 |
| Clear point | (°C.) | <0 | <0 | <0 | <5 |

For comparison the bipartite system water and the same sodium dodecyl secondary sulphate was studied at a range of anionic active levels.

The results in terms of active level and clear point of the system are given in Table VI below.

TABLE VI

| | | | | |
|---|---|---|---|---|
| Active | (wt %) | 67 | 57 | 55 |
| Clear point | (°C.) | >25 | >25 | >25 |

EXAMPLE 7

The tripartite system water, sodium dinonyl phosphate (available commercially as Lensodel A) and the polyether $C_{16}E_{20}$ (available commercially as Brij 58) was studied over a range of temperatures at varying water concentrations whilst maintaining the weight ratio of anionic to nonionic constant at 1:1.

The results are given in Table VII below in terms of total active present versus clear point.

TABLE VII

| | | | | | | | |
|---|---|---|---|---|---|---|---|
| Total active | (wt %) | 84 | 78 | 70 | 60 | 54 | 44 |
| Clear point | (°C.) | <25 | <25 | <25 | <25 | <25 | <25 |

EXAMPLE 8

The tripartite system water, sodium tetradecyl benzene sulphonate with benzene ring attached to the tetradecyl chain at $C_7$, and the polyether $C_{16}E_{20}$ (available commercially as Brij 58) was studied to establish its clear point at varying water concentrations whilst keeping the weight ratio of anionic to nonionic constant at 1:1.

The results are given in Table VIII below.

TABLE VIII

| | | | | |
|---|---|---|---|---|
| Total active | (wt %) | 78 | 65 | 55 |
| Clear point | (°C.) | <40 | >40 | 40 |

What is claimed is:

1. An isotropic liquid detergent composition comprising (i) at least 40 wt% and less than 92 wt% of a mixture of surfactants, at least 50 wt% of the surfactants present comprising:

(a) a polyalkoxy nonionic surfactant, the nonionic surfactant having a hydrophile-lipophile balance of at least 14.5, said nonionic surfactant being $$CH_3(CH_2)_{n-1}(CH_2CH_2O)_mOH$$

wherein n ranges from 2 to 24 and m is an integer which will achieve said hydrophile-lipophile balance; and (b) an anionic surfactant having a non-terminal ionic head group with two or more hydrocarbon chains extending from the head group, each chain being no more than 10 carbon atoms in length and the chains having a total length of at least 8 carbon atoms, said ionic surfactant selected from the group consisting of dialkyl sulphosuccinate, secondary alkyl sulfate, dialkyl phosphate, and alkylbenzene sulfonate, said sulfonate having a benzene ring attached to a secondary alkyl carbon atom;

wherein the ratio of (a) to (b) lies within the range of from 1:9 to 9:1, and (ii) at most 60 wt% and more than 8 wt% water, said liquid detergent composition being free of additional hydrotropes.

2. A composition according to claim 1 comprising at least 60 wt% of the mixure of surfactants (i).

3. A composition according to claim 2 comprising at least 80 wt% of the mixture of surfactants (i).

4. A composition according to claim 1 wherein the ratio of (a) to (b) lies within the range 1:2 to 2:1.

5. A composition according to claim 1 wherein the said mixture includes additional surfactants, any additional ionic surfactant present having the same charge as the ionic surfactant (b).

6. A composition according to claim 1 wherein each hydrocarbon chain of ionic surfactant (b) is less than or equal to 8 C.

7. A composition according to claim 6 wherein each hydrocarbon chain of ionic surfactant (b) is less than or equal to 7 C.

8. A composition according to claim 1 wherein the shortest hydrocarbon chain of ionic surfactant (b) is 2 C.

9. A composition according to claim 1 wherein the shortest length of a hydrocarbon chain of ionic surfactant (b) is 4 C.

10. A composition according to claim 1 wherein the nonionic surfactant is a polyethoxy·surfactant and has an HLB of at least 15.

11. A composition according to claim 1 wherein the nonionic surfactant is a polyethoxy surfactant and has an HLB of at most 19.

12. A composition according to claim 11 wherein the nonionic polyethoxy surfactant has an HLB of at most 17.

13. A composition according to claim 1 wherein n is at most 16.

14. A composition according to claim 1 wherein n is at most 12.

15. A composition according to claim 1 wherein the secondary alkyl sulfate is sodium dodecyl secondary sulfate.

* * * * *